US010699647B2

(12) United States Patent
Wang

(10) Patent No.: US 10,699,647 B2
(45) Date of Patent: Jun. 30, 2020

(54) DRIVING SYSTEM OF DISPLAY SCREEN AND DRIVING METHOD THEREOF

(71) Applicant: Shenzhen China Star Optoelectronics Technology Co., Ltd., Shenzhen, Guangdong (CN)

(72) Inventor: Limin Wang, Guangdong (CN)

(73) Assignee: Shenzhen China Star Optoelectronics Semiconductor Display Technology Co., Ltd, Shenzhen, Guangdong (CN)

( * ) Notice: Subject to any disclaimer, the term of this patent is extended or adjusted under 35 U.S.C. 154(b) by 268 days.

(21) Appl. No.: 15/541,567

(22) PCT Filed: Jun. 13, 2017

(86) PCT No.: PCT/CN2017/088028
§ 371 (c)(1),
(2) Date: Jul. 5, 2017

(87) PCT Pub. No.: WO2018/188187
PCT Pub. Date: Oct. 18, 2018

(65) Prior Publication Data

US 2018/0293945 A1 Oct. 11, 2018

(51) Int. Cl.
*G09G 3/36* (2006.01)
*G09G 5/00* (2006.01)
*G09G 3/3291* (2016.01)

(52) U.S. Cl.
CPC ..... *G09G 3/3291* (2013.01); *G09G 3/3688* (2013.01); *G09G 2310/08* (2013.01);
(Continued)

(58) Field of Classification Search
CPC .. G09G 5/00; G09G 5/02; G09G 5/10; G09G 5/18; G09G 3/30; G09G 3/32; G09G 3/36;
(Continued)

(56) References Cited

U.S. PATENT DOCUMENTS

2004/0252111 A1* 12/2004 Cheon ..... G09G 3/20 345/204
2006/0097969 A1* 5/2006 Tsai ..... G09G 3/20 345/88
2007/0290984 A1* 12/2007 Yang ..... G09G 3/3696 345/101
2008/0018569 A1* 1/2008 Sung ..... G09G 3/3233 345/82
2008/0088545 A1* 4/2008 Chen ..... G09G 3/3225 345/76
(Continued)

FOREIGN PATENT DOCUMENTS

CN 101320545 A 12/2008
CN 105469740 A 4/2016
CN 105679265 A 6/2016

*Primary Examiner* — Chanh D Nguyen
*Assistant Examiner* — Nguyen H Truong
(74) *Attorney, Agent, or Firm* — Andrew C. Cheng

(57) ABSTRACT

The present invention discloses a driving system of a display screen and a driving method thereof, the driving system includes: a temperature detecting circuit, for detecting a temperature of a display area of a display screen; a compensation calculation circuit, coupled to the temperature detection circuit, for calculating a compensation control signal of a display voltage of the temperature; and a data driving circuit, coupled to the compensation calculation circuit, for generating a display voltage signal matching the display voltage compensation control signal and transmitting to the display screen. By the driving system, the brightness of the display screen changed with the temperature can be avoided effectively, and the display quality is ensured.

6 Claims, 4 Drawing Sheets

(52) U.S. Cl.
CPC ..... *G09G 2320/0233* (2013.01); *G09G 2320/0295* (2013.01); *G09G 2320/041* (2013.01); *G09G 2320/0673* (2013.01)

(58) Field of Classification Search
CPC .. G09G 3/3291; G09G 3/3241; G09G 3/3258; G09G 3/3696; G09G 3/3688; G09G 3/3677; G09G 3/2003; G09G 3/3266; G09G 3/342; G09G 3/3607; G09G 3/3614; G09G 3/3685; G09G 3/3604; G09G 3/3648; G09G 3/2074; G09G 3/2018; G09G 3/3275; G09G 3/3225; G02F 1/133; G02F 1/133382; G02F 1/1368; G02F 1/1343
See application file for complete search history.

(56) References Cited

U.S. PATENT DOCUMENTS

2009/0040163 A1* 2/2009 Sun ..... G09G 3/3696 345/98
2010/0265228 A1* 10/2010 Kimura ..... G09G 3/3233 345/207
2010/0277519 A1* 11/2010 Lee ..... G09G 3/3406 345/691
2011/0096105 A1* 4/2011 Park ..... G09G 3/36 345/690
2014/0062981 A1* 3/2014 Huang ..... G09G 3/3648 345/211
2016/0005365 A1 1/2016 Choi et al.
2017/0309241 A1* 10/2017 Shin ..... G09G 3/3677
2018/0293937 A1* 10/2018 Tong ..... G09G 3/20

* cited by examiner

DRIVING SYSTEM OF DISPLAY SCREEN AND DRIVING METHOD THEREOF

TECHNICAL FIELD

The present invention relates to display technology field, in particularly to a driving system of a display screen and a driving method thereof.

BACKGROUND OF RELATED ART

During the normal display of the display device, the difference between the display image and the ambient temperature will cause the display screen to have a significant difference in the operating temperature, and the change of the temperature will cause the change of the characteristic of the thin film transistor in the display screen, such as mobility, and then result in the change of display brightness.

The setting of the pixel voltage for the traditional display screen is adjusted and determined in a fixed environment, the difference of the brightness in the different working environment is obvious, thus affecting the display quality. To ensure that the brightness of the display screen does not change with the temperature change, the industry will usually modify the video data code based on the measured screen temperature, but this way will reduce the dynamic range of video data.

Based on this, how to solve the problem that the brightness of the display screen changes due to the change of the screen body temperature in the prior art becomes a technical problem that needs to be solved urgently by those skilled in the art.

SUMMARY

The technical problem that the present invention mainly solves is to provide a driving system of a display screen and a driving method thereof, which can effectively avoid the change of the brightness of the display screen with the temperature change and ensure the display quality.

To solve the technical problem, one technical proposal of the present invention is to provide a driving system for the display screen, including:

a temperature detection circuit, for detecting the temperature of the display area of the display screen;

a compensation calculation circuit, coupled to the temperature detection circuit, for calculating a compensation control signal of a display voltage of the temperature;

and a data driving circuit, coupled to the compensation calculation circuit, generating a display voltage signal matching the display voltage compensation control signal and transmitting to the display screen, wherein the compensation calculation circuit includes a timing control (TCON) circuit, a gamma selection circuit, and a gamma generating circuit sequentially coupled, the timing control (TCON) circuit being coupled to the temperature detection circuit, and the gamma generating circuit being coupled to the data driving circuit;

the temperature detection circuit including:

a measurement unit, for measuring a temperature value of at least one of pixels on the display screen;

a calculation unit, coupled to the compensation calculation circuit, for calculating an average value of the temperature of at least one the pixels.

To solve the technical problem, another technical proposal of the present invention is to provide a driving system for the display screen, including:

a temperature detection circuit, for detecting the temperature of the display area of the display screen;

a compensation calculation circuit, coupled to the temperature detection circuit, for calculating a compensation control signal of a display voltage of the temperature;

and a data driving circuit, coupled to the compensation calculation circuit, for generating a display voltage signal matching the display voltage compensation control signal and transmitting to the display screen, To solve the technical problem, still another technical proposal of the present invention is to provide a driving system for the display screen, including:

detecting a temperature of a display area;

calculating a compensation control signal of a display voltage of the temperature;

and generating a display voltage signal matching the display voltage compensation control signal and transmitting to the display screen.

The beneficial effect of the present invention is that by measuring the temperature of the display area of the display screen, calculating a compensation control signal of a display voltage of the temperature to generate a display voltage signal matching the display voltage compensation control signal and transmitting to the display screen, the brightness of the display screen changed with the temperature change can be effectively avoided, and the display quality is ensured; simultaneously, the location of measuring the temperature is located in the display area of the display screen, which can reflect the temperature environment in the screen body and improve the accuracy of the measurement result.

DETAILED DESCRIPTION OF EMBODIMENTS

Figure 1:
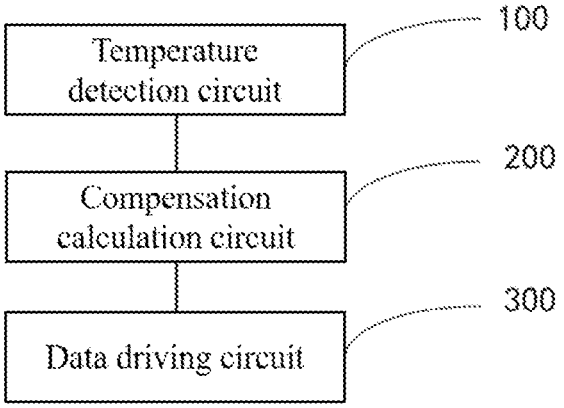
FIG. 1 is a schematic structural view of an embodiment of a driving system of a display screen according to the present invention.

Referring to FIG. 1, FIG. 1 is a schematic structural view of an embodiment of a driving system of a display screen of the present invention, which includes: a temperature detection circuit 100, a compensation calculation circuit 200, and a data driving circuit 300.

The temperature detection circuit 100, for detecting the temperature of the display area of the display screen;

Optionally, in this embodiment, the temperature detection circuit 100 measures the temperature of the middle portion of the display area. Of course, in other embodiments, it may also measure the temperature around the display area or the detection position may be evenly distributed in the display area of the display screen. Specifically, the specific measurement positions can be set by the designer through their experiences to be able to typically reflect the temperature of the display screen. After the temperature of the display screen is measured, the measured temperature is calculated accordingly. For example, the highest temperature or the lowest temperature or the average temperature in the display area is calculated.

A compensation calculation circuit 200, coupled to the temperature detection circuit 100, for calculating a compensation control signal of a display voltage of the temperature detected by the temperature detection circuit 100.

After the temperature detection circuit 100 detects the temperature of the display area of the display screen, the compensation calculation circuit 200 calculates the display voltage compensation control signal of the temperature with the temperature as a parameter according to the formula or the algorithm. Specifically, the formula or algorithm can be obtained by the designer through experience or a summary of a large amount of experiments.

The data driving circuit 300, coupled to the compensation calculation circuit 200, for generating a display voltage signal matching the display voltage compensation control signal and transmitting to the display screen.

After the compensation calculation circuit 200 calculates the display voltage compensation control signal, the data driving circuit 300 generates a display voltage signal matching the display voltage compensation control signal, specifically, as far as the display screen whose brightness becomes higher as the temperature of the display screen increases is concerned, the display voltage signal is inversely proportional to the temperature measured in the temperature detection circuit 100, that is, the higher the temperature detected in the temperature detection circuit 100 is, the lower the display voltage signal generated in the data driving circuit 300 will be; and as far as the display screen whose brightness becomes lower as the temperature of the display screen increases is concerned, the display voltage signal is proportional to the temperature measured in the temperature detection circuit 100, that is, the higher the temperature detected in the temperature detection circuit 100 is, the higher the display voltage signal generated in the data driving circuit 300 will be.

The display screen receives the display voltage signal and performs the corresponding brightness adjustment; specifically, when the received display voltage signal goes low, the brightness of the display screen is reduced, and when the received display voltage signal goes high, the brightness of the display screen is increased, when the received display voltage signal is not changed, the brightness of the display screen is kept constant, so that the brightness of the display screen changed with the temperature change can be effectively avoided, or the brightness of the display screen can be effectively reduced to improve the display effect and ensure the display quality.

The driving system in the embodiment can not only drive the liquid crystal display screen but also the organic light emitting display screen or other display screen, and is not limited thereto.

Figure 2:
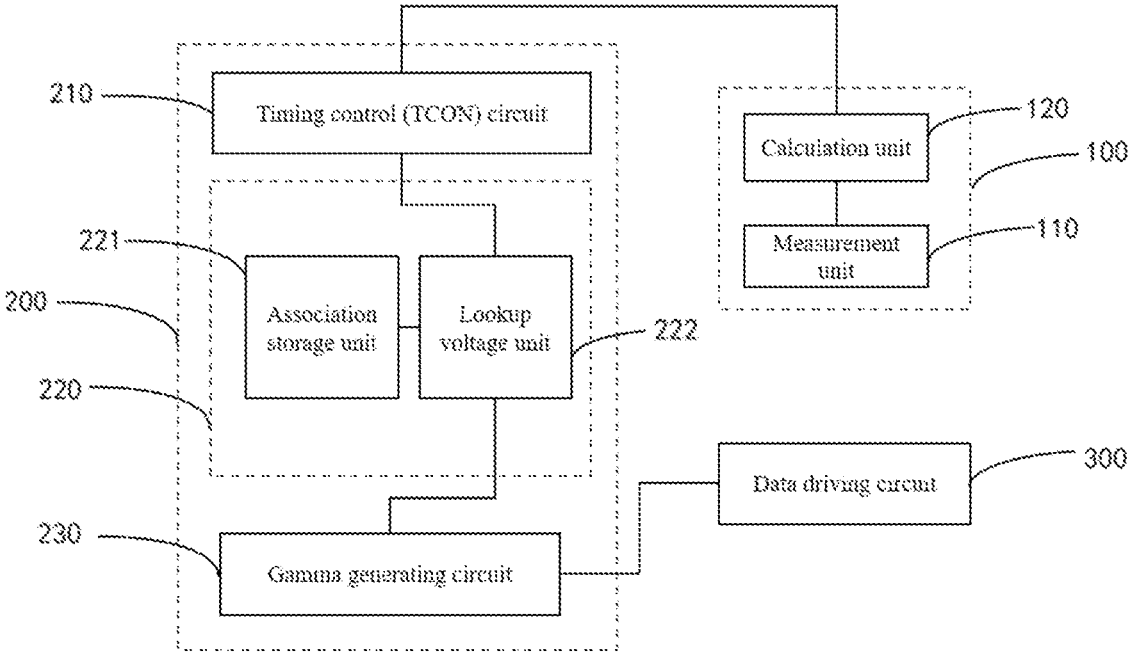
FIG. 2 is a schematic structural view of another embodiment of the driving system of the display screen according to the present invention.

Referring to FIG. 2, in another embodiment of the driving system of the display screen of the present invention, the temperature detection circuit 100 specifically includes: a measurement unit 110 and a calculation unit 120.

The measurement unit 110 includes at least one measurement element, such as a temperature sensor, for measuring the temperature value of at least one of pixels on the display screen. The number of measurement components and the measurement location may be designed and adjusted as needed.

The calculation unit 120, coupled to the measurement unit 110, for calculating an average value of the temperature of at least one of the pixels. It can be understood that in other embodiments the calculation unit 120 may also calculate the highest or lowest value of the temperature of at least one of the pixels.

The compensation calculation circuit 200 specifically includes a timing control (TCON) circuit 210, a gamma selection circuit 220, and a gamma generating circuit 230.

The timing control (TCON) circuit 210 is coupled to the calculation unit 120, the gamma generating circuit 230 is coupled to the data driving circuit 300, and the timing control (TCON) circuit 210, the gamma selection circuit 220, and the gamma generating circuit 230 are sequentially coupled.

Specifically, the gamma selection circuit 220 includes:

an association storage unit 221, for storing a corresponding relation between a pre-divided temperature range and a gamma voltage associated with the temperature range;

the temperature range of the display screen is divided as needed, for example, the temperature of the display screen is divided into 0~20° C., 20~40° C., and 40~60° C., and a gamma voltage corresponding to each temperature range is set, and specifically, as far as a display screen whose brightness becomes lower as the temperature of the display screen increases is concerned, when the temperature of the display screen is too high, the brightness of the display screen needs to be reduced to avoid the problem that the brightness is too high and the lifetime decay rate is too fast caused by the high temperature; when the temperature of the display screen is too low, the loss of brightness caused by the low temperature needs to be compensated; therefore, in this embodiment the gamma voltage corresponding to 40~60° C. is set to a low value, the gamma voltage corresponding to 20~60° C. is set to a median value, and the gamma voltage corresponding to 0~20° C. is set to a high value; the association storage unit 221 stores the corresponding relation between the temperature range and the gamma voltage associated with the temperature range in the form of a lookup table. It should be noted that the low value, the median value, and the high value are relative concepts, and it can be understood that the relation between the temperature range and the gamma is inversely proportional, that is, the higher temperature is, the lower the corresponding gamma voltage will be. Simultaneously, the division of the temperature range may be set as specifically needed, may be refined into multiple groups.

A lookup voltage unit 222, coupled to a timing control (TCON) circuit 210 and an association storage unit 221, for searching the matching temperature range of the temperature calculated by calculation unit 120 in the association storage section 221 based on the timing control signal generated by the timing control (TCON) circuit 210, and then searching out the gamma voltage corresponding to the temperature range.

Simultaneously, the gamma generating circuit 230 is coupled to the lookup voltage unit 222, for generating the lookup gamma voltage as the display voltage compensation control signal.

Further, the data driving circuit 300 is coupled to the gamma generating circuit 230, for receiving the display voltage compensation control signal, generating the display voltage signal matching the display voltage compensation control signal, and transmitting to the display screen. Specifically, in this embodiment the display voltage signal is inversely proportional to the measured temperature of the display screen, that is, the higher the measured temperature is, the lower the output display voltage signal will be.

The display screen receives the display voltage signal and performs the corresponding brightness adjustment; specifically, when the received display voltage signal goes high, the brightness of the display screen is increased, when the received display voltage signal goes low, the brightness of the display screen is reduced, and when the received display voltage signal is not changed, the brightness of the display screen is kept constant, so that the brightness of the display screen changed with the temperature change can be effectively avoided, and the display quality is ensured.

Figure 3:
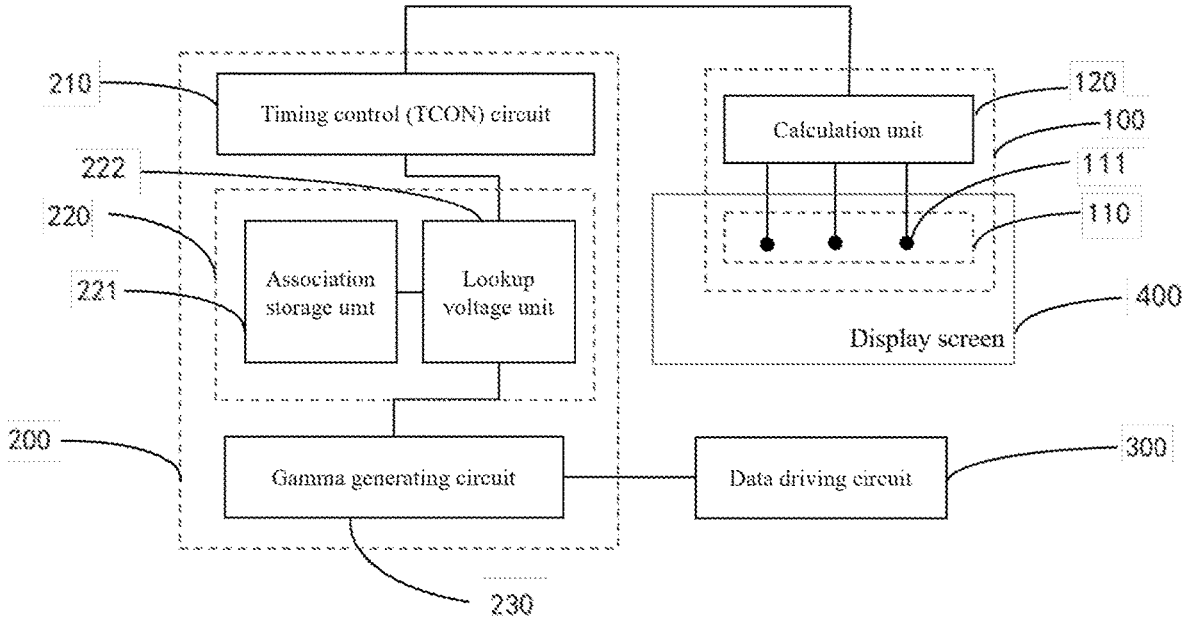
FIG. 3 is a schematic view when the display screen is driven by the driving system in the embodiment of FIG. 2.

Referring to FIG. 3, FIG. 3 is a schematic view when the display screen is driven by the driving system in the embodiment of FIG. 2.

Specifically, the measurement element 111 in the measurement unit 110 measures the temperature of at least one of the pixels on the display screen 400 so that the calculation unit 120 calculates the average value of the temperature value of at least one of the pixels, thereby generates the gamma voltage corresponding to the temperature of the display screen 400 by the compensation calculation circuit 200 as the display voltage compensation control signal; the display circuit 300 outputs the display voltage signal to the display screen 400 in accordance with the display voltage compensation control signal, and the display screen 400 performs the adjustment in accordance with the display voltage signal.

Figure 4:
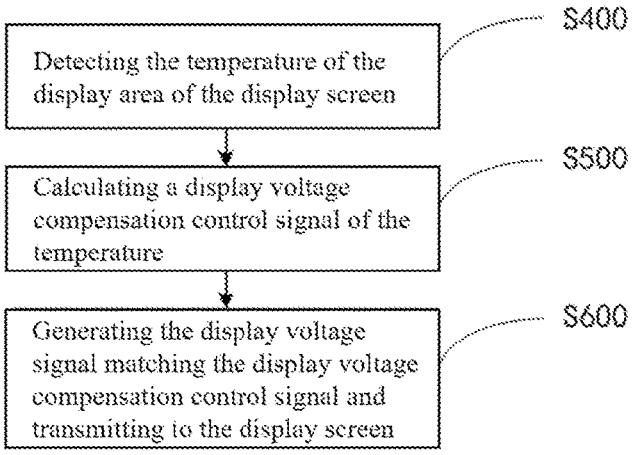
FIG. 4 is a flow diagram of an embodiment of the driving method of the display screen according to the present invention.

Referring to FIG. 4, FIG. 4 is a flow diagram of an embodiment of the driving method of the display screen according to the present invention, which includes:

S400: detecting the temperature of the display area of the display screen.

Figure 5:
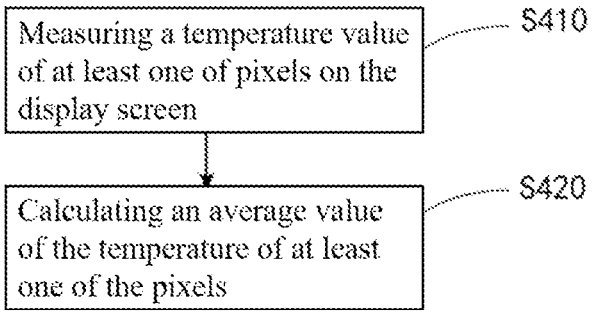
FIG. 5 is a schematic flow diagram of step S400 in another embodiment of the driving method of the display screen according to the present invention.

Using the measuring element to measure the temperature of the display area in the display screen, referring to FIG. 5, in another embodiment of the driving method of the display screen in the present invention, the step S400 specifically includes:

S410: measuring a temperature value of at least one of pixels on the display screen.

Use the measuring element to measure the temperature value of at least one of pixels on the display screen, the number of measuring elements and the measurement position are set according to the specific situation, which are not restricted here.

S420: calculating an average value of the temperature of at least one of the pixels.

Calculate the average value of the measured temperature instep S410.

It is to be understood that in still another embodiment of the driving method of the display screen of the present invention, step S420 may also calculate the highest or lowest value of the temperature value of at least one pixel.

S500: calculating a display voltage compensation control signal of the temperature.

Calculate the compensation control signal of the display voltage of the temperature according to the temperature detected in step S400.

Figure 6:
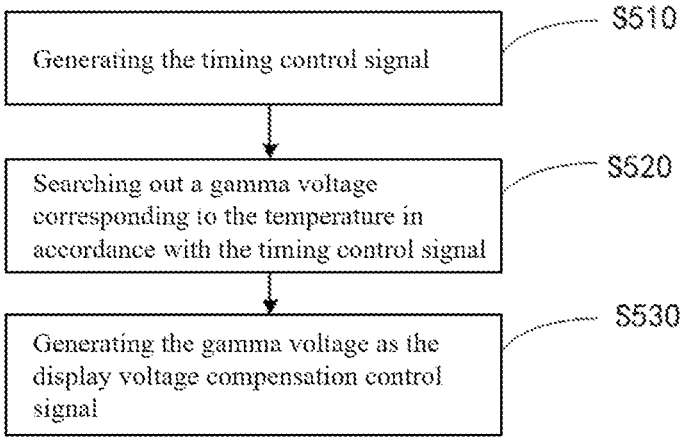
FIG. 6 is a schematic flow diagram of step S500 in another embodiment of the driving method of the display screen according to the present invention.

Referring to FIG. 6, in another embodiment of the driving method of the display screen of the present invention, step S500 specifically includes:

S510: generating the timing control signal.

Figure 7:
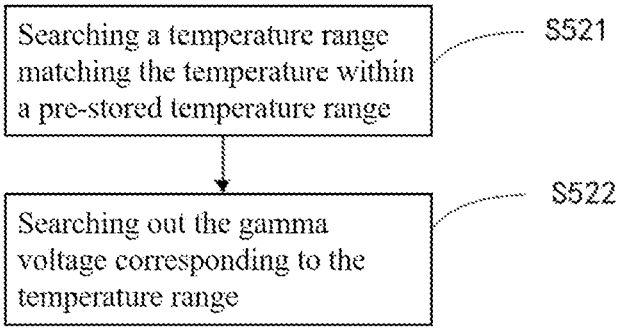
FIG. 7 is a flow chart of step S520 in another embodiment of the driving method of the display screen according to the present invention.

S520: searching out a gamma voltage corresponding to the temperature in accordance with the timing control signal;

Referring to FIG. 7, in another embodiment of the driving method of the display screen of the present invention, step S520 further includes:

S521: searching the temperature range matching the temperature within a pre-stored temperature range;

the stored temperature range of the display screen is divided into 5~20° C., 20~35° C., 35~50° C., and 50~65° C., for example. Search out the temperature range matching the measured temperature in the stored temperature range in accordance with the timing control signal.

S522: searching out the gamma voltage corresponding to the temperature range.

After searching out the temperature range matching the measured temperature, search the gamma voltage corresponding to the temperature range.

The gamma voltage corresponding to the temperature range is set in advance. For example, in this embodiment, as far as a display screen whose brightness becomes lower as the temperature of the display screen increases is concerned, when the temperature of the display screen is too high, the brightness of the display screen needs to be reduced to avoid the problem that the brightness is too high and the lifetime decay rate is too fast caused by the high temperature, so the temperature of the display is divided into 5~20° C., 20~35° C., 35~50° C., and 50° C.~65° C., the gamma voltage corresponding to 50° C.~65° C. is set to a low value, and the gamma voltage corresponding to 35~50° C. is set to a median value, the gamma voltage corresponding to 20~35° C. is set to the middle value, the gamma voltage corresponding to 5~20° C. is set to a high value, and the corresponding relation between the divided temperature range and the gamma voltage corresponding to the temperature range is stored as a lookup table. It should be understood that the low value, the median value, the middle value, and the high value are relative concepts, and it can be understood that the relation between the temperature range and the gamma is inversely proportional, that is the higher temperature is, the lower the corresponding gamma voltage will be set. Simultaneously, the division of the temperature range may need to set specific needs, and may be refined into multiple groups.

S530: generating the gamma voltage as the display voltage compensation control signal.

After searching the gamma voltage corresponding to the measured temperature, the gamma voltage is generated and the gamma voltage is used as the display voltage compensation control signal.

S600: generating a display voltage signal matching the display voltage compensation control signal and transmitting to the display screen.

Generate the display voltage signal matching the display voltage compensation control signal and transmit to the display screen. Specifically, in this embodiment, the measured temperature is inversely proportional to the displayed display voltage, i.e., the higher the measured temperature is, the lower the display voltage delivered to the display screen will be. After the display screen receives the display voltage, the adjustment of the corresponding brightness is performed; specifically, when the received display voltage signal goes high, the brightness of the display screen is increased, when the received display voltage signal goes low, the brightness of the display screen is reduced, and when the received display voltage signal is not changed, the brightness of the display screen is kept constant, so that the brightness of the display screen changed with the temperature change can be effectively avoided, and the display quality is ensured.

The driving method of the display screen in the present invention is a driving method for the driving system to the display screen in the embodiment. The specific driving system can be seen in the embodiment and will not be described here.

In contrast to the prior art, on one aspect of the present invention by measuring the temperature of the display area of the display screen, calculating a compensation control signal of a display voltage of the temperature to generate a display voltage signal matching the display voltage compensation control signal and to transmit to the display screen, the brightness of the display screen changed with the temperature change can be effectively avoided, and the display quality is ensured; on the other aspect, the location for measuring the temperature is located in the display area, which can reflect the temperature environment in the screen body and improve the accuracy of the measurement result.

Above are only embodiments of the present invention, are not patented and therefore limit the scope of the present invention, the use of any content of the present specification and drawings made equivalent or equivalent structural transformation process, either directly or indirectly related to the use of other technologies areas are included in the same way the scope of the patent protection of the present invention.

What is claimed is:

1. A driving system for a display screen, comprising:

a temperature detection circuit, for detecting a temperature of a display area of the display screen;

a compensation calculation circuit, coupled to the temperature detection circuit, for calculating a display voltage compensation control signal based on the temperature and a change relation between the temperature and brightness of the display screen; and a data driving circuit, coupled to the compensation calculation circuit, for generating a display voltage signal matching the display voltage compensation control signal and transmitting to the display screen, wherein the compensation calculation circuit comprises a sequentially coupled a timing control (TCON) circuit, a gamma selection circuit, and a gamma generating circuit, and the timing control (TCON) circuit is coupled to the temperature detection circuit, and the gamma generating circuit is coupled to the data driving circuit;

wherein the gamma selection circuit comprises:

an association storage, for storing a corresponding relation between a pre-divided temperature range and a gamma voltage associated with the temperature range; and a voltage searcher, coupled to the timing control (TCON) circuit and the association storage, for searching the temperature range matching the temperature within the association storage, and then searching out the gamma voltage corresponding to the temperature range;

simultaneously, the gamma generating circuit being coupled to the voltage searcher, for generating the gamma voltage as the display voltage compensation control signal;

wherein the gamma voltage corresponding to 40-60° C. is set to a low value; the gamma voltage corresponding to 20-40° C. is set to a median value larger than the low value; and the gamma voltage corresponding to 0-20° C. is set to a high value larger than the median value.

2. The driving system according to claim 1, wherein the temperature detection circuit measures a temperature value of at least one of pixels on the display screen and calculates an average value of the temperature of the at least one of pixels.

3. The driving system according to claim 1, wherein the display voltage signal generated to match the display voltage compensation control signal means that the temperature is inversely proportional to the display voltage signal.

4. A method for driving a display screen, comprising:

detecting a temperature of a display area;

calculating a display voltage compensation control signal based on the temperature and a change relation between the temperature and brightness of the display screen; and generating a display voltage signal matching the display voltage compensation control signal and transmitting to the display screen;

wherein the method for calculating the display voltage compensation control signal of the temperature comprises:

generating a timing control signal;

searching a temperature range matching the temperature within a pre-stored temperature range;

searching out a gamma voltage corresponding to the temperature range, wherein the temperature range and the gamma voltage corresponding to the temperature range are pre-divided and set; and generating the gamma voltage as the display voltage compensation control signal;

wherein the gamma voltage corresponding to 40-60° C. is set to a low value; the gamma voltage corresponding to 20-40° C. is set to a median value larger than the low value; and the gamma voltage corresponding to 0-20° C. is set to a high value larger than the median value.

5. The method according to claim 4, wherein the method for detecting the temperature of the display area of the display screen comprises:

measuring a temperature value of at least one of pixels on the display screen;

calculating an average value of the temperature of the at least one of pixels.

6. The method according to claim 4, wherein the display voltage signal generated to match the display voltage compensation control signal means that the temperature is inversely proportional to the display voltage signal.

* * * * *